US006045407A

United States Patent [19]

Yamada et al.

[11] Patent Number: 6,045,407

[45] Date of Patent: Apr. 4, 2000

[54] ELECTRICAL CONNECTOR

[75] Inventors: Shoji Yamada; Takeshi Kimura, both of Ayase, Japan

[73] Assignee: Quasar System Inc., Kanagawa-ken, Japan

[21] Appl. No.: 09/030,802

[22] Filed: Feb. 26, 1998

[30] Foreign Application Priority Data

Dec. 22, 1997 [JP] Japan ..... 9-365611

[51] Int. Cl.[7] ..... H01R 25/00

[52] U.S. Cl. ..... 439/638; 439/59; 439/861

[58] Field of Search ..... 439/59, 61, 62, 439/630–637, 326–328, 751, 861–2, 638–9

[56] References Cited

U.S. PATENT DOCUMENTS

| | | | |
|---|---|---|---|
| 3,740,698 | 6/1973 | Jerominek | 339/176 |
| 4,505,528 | 3/1985 | Reimer | 339/74 R |
| 4,660,920 | 4/1987 | Shibano | 339/176 |
| 4,983,132 | 1/1991 | Weidler | 439/786 |
| 4,995,825 | 2/1991 | Korsunsky et al. . | |
| 5,094,624 | 3/1992 | Bakke et al. . | |
| 5,161,995 | 11/1992 | Bakke et al. . | |
| 5,277,621 | 1/1994 | Seto | 439/493 |
| 5,588,878 | 12/1996 | Flinchbaugh et al. | 439/682 |

FOREIGN PATENT DOCUMENTS 08171966 2/1996 Japan .

*Primary Examiner*—Lincoln Donovan
*Attorney, Agent, or Firm*—Smith, Gambrell & Russell, LLP

[57] ABSTRACT

An electrical connector having a housing with electrical part-receiving slots at both sides of the housing, to each of which each of two pieces of electrical parts would be inserted so that the both faces of the electrical parts would be reverse to each other. On the inner walls of the electrical part-receiving slots of the housing, retaining grooves are formed in a predetermined distance, and each retaining groove is provided with a common terminal which is connected to a wiring common to the two pieces of the electrical parts, a first independent terminal and a second independent terminal which are connected to different wirings for each electrical part. According to this electrical connector, not only two pieces of electrical parts can be inserted, but also wirings common to the electrical parts can be connected all together to a packaging board and the height of installation on the packaging board can be suppressed low.

3 Claims, 4 Drawing Sheets

ELECTRICAL CONNECTOR

FIELD OF THE INVENTION

The present invention relates to an electrical connector for connecting electrical parts such as memory modules to packaging boards such as CPU boards.

BACKGROUND OF THE INVENTION

Electrical parts such as memory modules are generally constructed by positioning semiconductor chips on a daughter board. Such electrical parts have terminal portions with terminals aligned in a predetermined pitch at the edge of the daughter board. Among them, ones having semiconductor chips disposed on both sides of the daughter board, and having terminals formed on both sides of the terminal portion, are called DIMM, and have formed the a mainstream of memory modules in recent years.

To dispose the above electrical parts on packaging boards such as CPU boards, electrical connector having slit-like receiving slots for receiving terminal portions of electrical parts are used. As such electrical connectors, ones having two electrical part-receiving slots which enable them to receive terminal portions of two pieces of electrical parts, have been known, by which the number of parts disposed on the packaging board can be reduced.

When, for example two pieces of memory modules are positioned, it is necessary in many cases to connect the terminals of signals common to two pieces of memory modules, such as a data bus, together to the corresponding circuits of a packaging board, and at the same time, to connect terminals of different signals such as row address select signals separately to the corresponding circuits of the packaging board. In such an instance, the above electrical connector having two electrical part-receiving slots is used. Otherwise, two usual electrical connectors each having one electrical part-receiving slot are used, and the two pieces of electrical parts are separately connected to the two corresponding circuits of the packaging board, and then the two corresponding circuits are connected with common wiring on the packaging board to accomplish the electrical connection.

FIGS. 4(*a*) and 4(*b*) show electrical connectors disclosed in Japanese Unexamined Patent Publication No. 8-171966. FIG. 4(*a*) is a cross-sectional view taken along the portion where independent terminals are arranged, and FIG. 4(*b*) is a cross-sectional view taken along the portion where common terminals are arranged.

As shown in FIGS. 4(*a*) and 4(*b*), the conventional electrical connector 100 has a structure having an insulating housing 110 and two slit-like electrical part-receiving slots 120, 130 disposed in an upright two-stage style, to each of which a terminal portion 210 of an electrical part 200 is inserted.

On opposed inner walls 121, 122, 131, 132 of the electrical part-receiving slots 120, 130, a plurality of grooves are formed in an alignment pitch corresponding to the terminals. To these grooves, a pair of independent terminals 140, 150 as shown in FIG. 4(*a*) or a common terminal 160 as shown in FIG. 4(*b*) are inserted.

As shown in FIG. 4(*a*), one independent terminal 140 has a contact portion 141 which extends along the upper inner wall 121 of the upper electrical part-receiving slot 120, a locking portion 142 to the housing 110, and a leg portion 143 which protrudes from the bottom portion of the rear face side of the housing 110. Further, another independent terminal 150 has a contact portion 151 which extends along the upper inner wall 131 of the lower electrical part-receiving slot 130, a locking portion 152 to the housing 110, and a leg portion 153.

Further, as shown in FIG. 4(*b*), the common terminal 160 has a first contact portion 161 which extends along the lower inner wall 122 of the upper electrical part-receiving slot 120, a second contact portion 162 which extends along the lower inner wall 132 of the lower electrical part-receiving slot 130, a locking portion 163 to the housing 110, and a leg portion 164.

The leg portions 143, 153, 164 of respective terminals 140, 150, 160, are connected to the wiring of a packaging board 300 by, for example, soldering. In this case, a terminal of signals common to two pieces of electrical parts, such as a data bus, are connected to the corresponding circuit of the packaging board 300 through the common terminal 160, and at the same time, terminals of different signals, such as a row address select signal, are separately connected to the corresponding circuits of the packaging board through the independent terminals 140, 150.

However, when such an electrical connector is disposed on the packaging board, since the electrical part-receiving slots to which two pieces of the electrical parts are inserted are constructed in an upright two-stage style as mentioned above, there is a problem that the height of installation of the electrical connector on the packaging board is higher than that of the case where an electrical connector to which only one piece of electrical part is inserted is disposed. Accordingly, if such an electrical connector is disposed on a CPU board of e.g. a note-type personal computer (a portable type personal computer), the height of installation of the electrical connector on the CPU board is too high, and it will be difficult to make the note-type personal computer sufficiently thin.

SUMMARY OF THE INVENTION

Accordingly, it is an object of the present invention to provide a small-type electrical connector which enables one to insert two pieces of electrical parts thereto, and to connect terminals common to the electrical parts together to a packaging board, and by which the height of installation on the packaging board can be kept low.

To accomplish the above object, the electrical connector of the present invention is an electrical connector for electrical parts which have a plate-like terminal portion with terminals aligned on both sides thereof, in a shifted fashion, which comprises a housing having slit-like electrical part-receiving slots to a of which each terminal portion of the electrical parts is inserted at opposing sides along the longitudinal direction, wherein to one of the electrical part-receiving slots the terminal portion of one electrical part is inserted, and to another one of the electrical part-receiving slots the terminal portion of another electrical part is inserted, so that the faces of one electrical part would be reverse to the faces of the other electrical part, wherein the housing comprises a plurality of common terminals having a first contact portion which abuts, from the upper side, on a specific terminal of the terminal portion of the electrical part at one side; a second contact portion which abuts, from the lower side, on a terminal corresponding to the specific terminal of the terminal portion of the electrical part at another side; a leg portion which protrudes from the lower face of the housing and abuts on a packaging board; and a locking portion to the housing; and a plurality of independent terminals having a contact portion which abuts on only a specific terminal of the terminal portion of the electrical part at either one side; a leg portion which abuts on the board; and a locking portion to the housing.

According to the present invention, the two electrical part-receiving slots to each of which the electrical part is inserted are formed at opposing side walls along the longitudinal direction of the housing, whereby it is possible not only to insert two pieces of the electrical parts, but also to reduce the height of the housing to the level of a conventional electrical connector capable of receiving only one electrical part. As a result, the space required for installing the electrical connector on the packaging board can be made small and the height of installation of the electrical connector can be kept low, whereby it becomes possible to realize the high densification and thin-model of the packaging board.

Further, to one of the electrical part-receiving slots, the terminal portion of one electrical part is inserted and to another one of the electrical part-receiving slots, the terminal portion of another electrical part is inserted so that the faces of one electrical part would be reverse to the faces of the other electrical part. By such a structure, when two pieces of electrical parts having the same structure, for example, memory modules, are inserted, the corresponding terminals can be aligned along the same line. Accordingly, common terminals of, for example, a data bus, can be commonly used with common terminals, thereby reducing the contact portions to the packaging board to improve the operation efficiency, whereby the possible failure of the connection can be reduced and the reliability can be increased.

According to the preferred embodiment of the present invention, the independent terminal consists of a first independent terminal which comprises a contact portion which abuts, from the lower side, on a specific terminal of the terminal portion of either one electrical part; a leg portion which protrudes from one side edge of the lower face of the housing and abuts on the packaging board; and a locking portion to the housing; and a second independent terminal which comprises a contact portion which abuts, from the upper side, on a specific terminal of the terminal portion of either one electrical part; a leg portion which protrudes from the center of the lower face of the housing and abuts on the packaging board; and a locking portion to the housing; wherein the first independent terminal and the second independent terminal are aligned in pairs along the same line so that they would abut on the corresponding terminals of the terminal portions of a pair of electrical parts.

According to this embodiment, with respect to the corresponding terminal of a pair of electrical parts which are inserted having both faces reversed to each other, the first independent terminal abuts, from the lower side, on the terminal portion of one electrical part; and the second independent terminal abuts, from the upper side, on the terminal portion of another electrical part. By such a structure, to each of the corresponding terminals aligned at the same line of respective electrical parts, an independent terminal can be contacted, whereby it becomes possible to connect the terminals of different signals, such as row address select signals.

According to another preferred embodiment of the present invention, adjacent to the leg portion of the second independent terminal, a pin portion which is inserted into a through hole formed on the packaging board, is provided. According to this structure, even if the leg portion of the second independent terminal which protrudes from the center of the lower face of the housing is not securely soldered to the terminal of the packaging board, failure of soldering can be prevented by soldering the pin portion inserted into the through hole from the rear face side of the packaging board.

BRIEF DESCRIPTION OF THE DRAWINGS

FIG. 1(*a*) is a plane view and FIG. 1(*b*) is an end view.

FIG. 2(*a*) is a cross-sectional view taken at a part where the common terminal is disposed. FIG. 2(*b*) is a cross-sectional view taken at a part where the independent terminals are disposed.

FIG. 4(*a*) is a cross-sectional view taken at a part where the independent terminals are disposed, and FIG. 4(*b*) is a cross-sectional view taken at a part where the common terminal is disposed,

DESCRIPTION OF THE PREFERRED EMBODIMENTS

Figure 1:
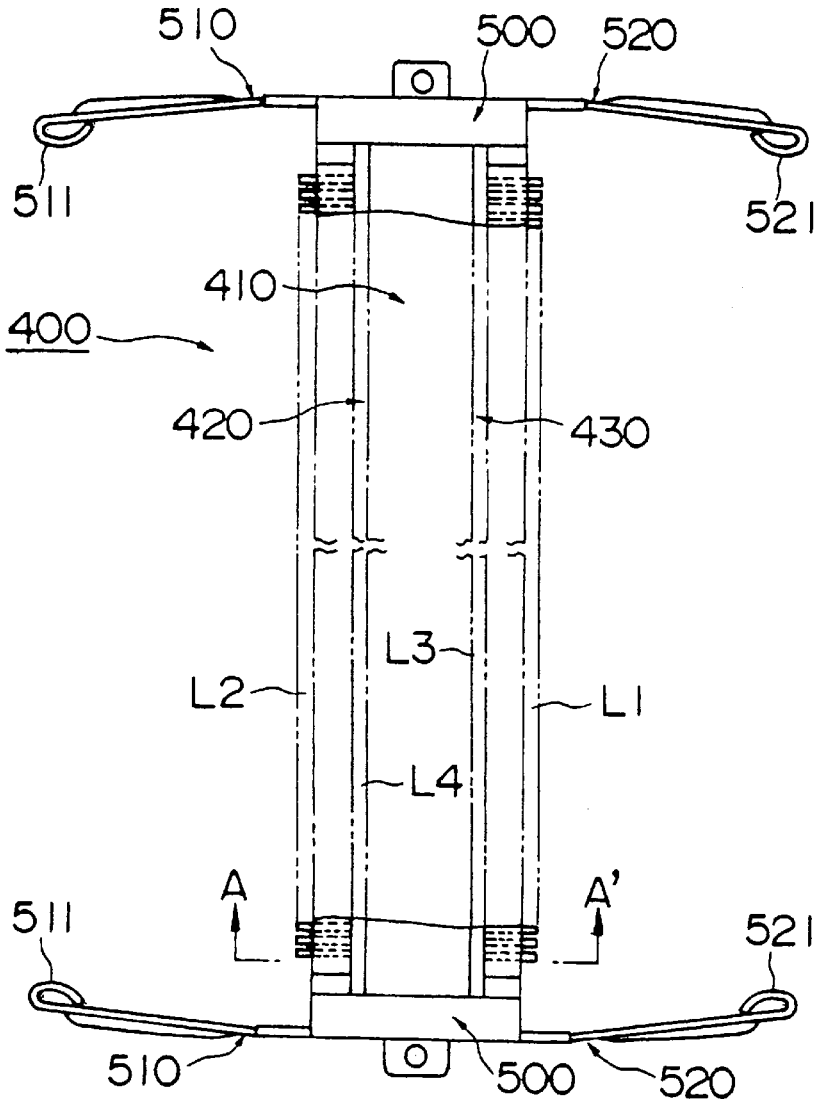
FIGS. 1(*a*) and 1(*b*) show one embodiment of the electrical connector of the present invention.
Figure 1:
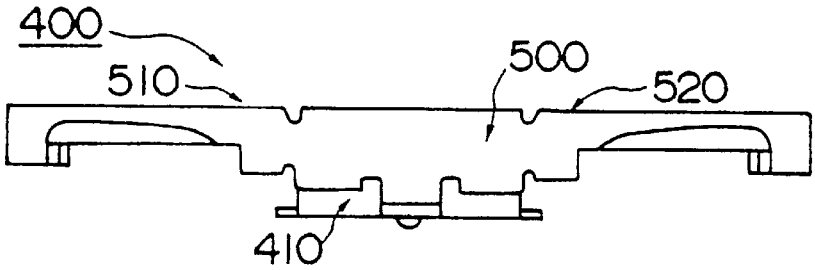
Figure 2:
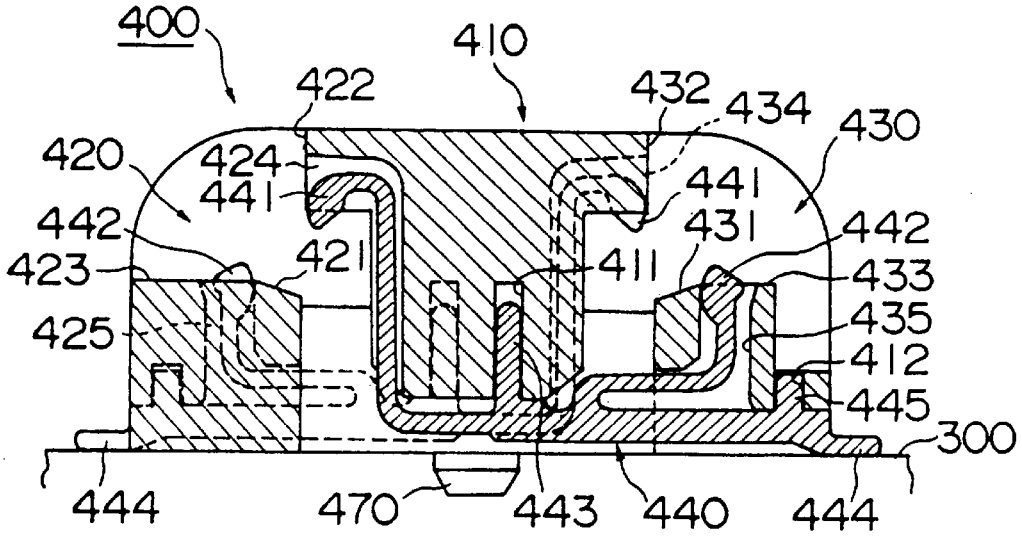
FIGS. 2(*a*) and 2(*b*) are cross-sectional views of the electrical connector taken along the arrow line A–A' direction in FIG. 1(*a*).
Figure 2:
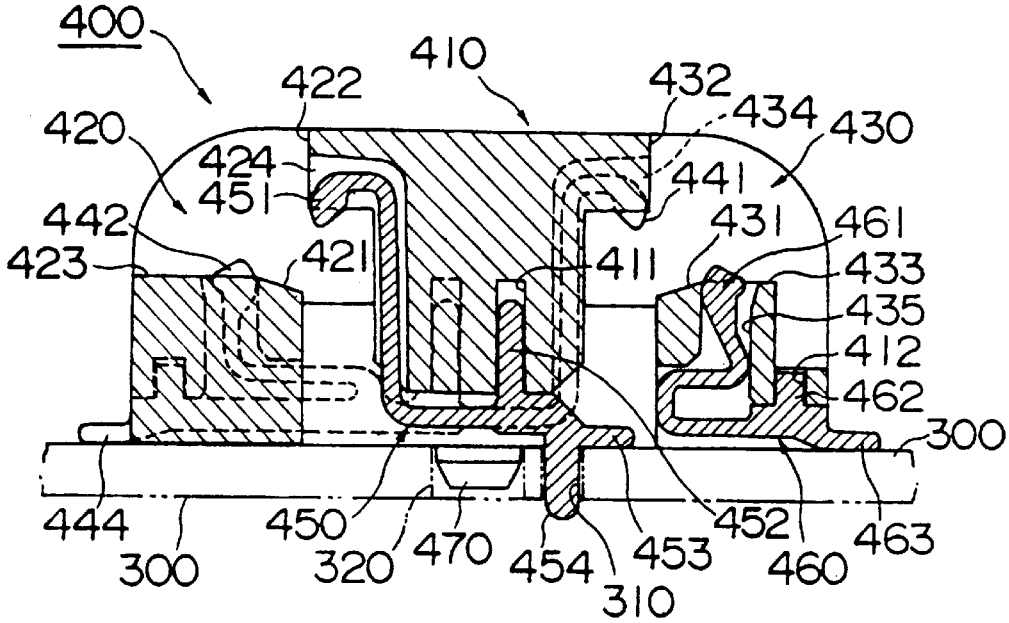
Figure 3:
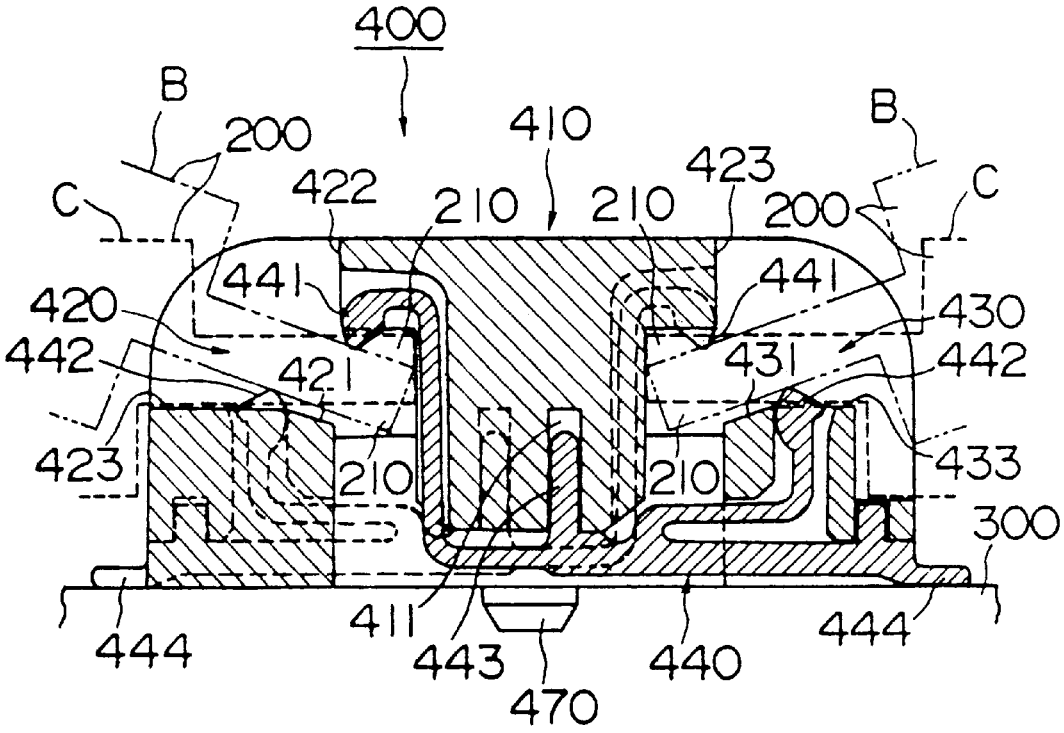
FIG. 3 shows a state where two pierces of the electrical parts are inserted into the electrical connector, and is a cross-sectional view having the same structure as in FIG. 2(*a*).
Figure 4:
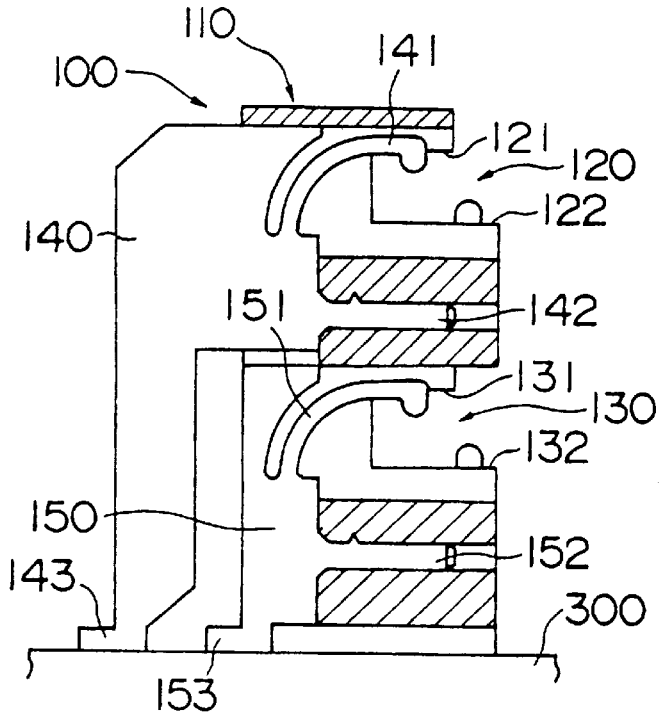
Fig. 4 (a) PRIOR ART
FIGS. 4(*a*) and 4(*b*) show the electrical connector disclosed in Japanese Unexamined Patent Application No. 8-171966.
Figure 4:
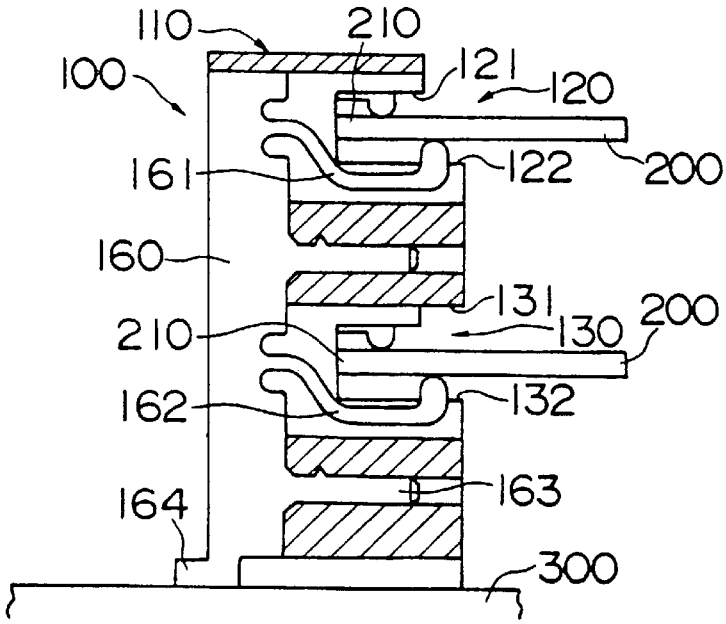
Fig. 4 (b) PRIOR ART

FIGS. 1(*a*) to 3 show an embodiment of the electrical connector of the present invention. FIG. 1(*a*) is a plane view of the electrical connector, FIG. 1(*b*) is an end view of the electrical connector. FIG. 2(*a*) is a cross-sectional view taken along the arrow line A–A' direction in FIG. 1 (*a*), at a part where the common terminal is disposed; FIG. 2(*b*) is a cross-sectional view taken along the arrow line A–A' direction in FIG. 1(*a*), at a part where the independent terminals are disposed; and FIG. 3 is a view showing a state where two pieces of the electrical parts are inserted, and has the same structure as in FIG. 2(*a*). Here, the parts substantially the same as in the conventional example in FIGS. 4(*a*) and 4(*b*), are indicated with the same numerals, and detailed explanation for them will be omitted.

As shown in FIGS. 1(*a*) and 1(*b*), an electrical connector 400 is provided with an insulating housing 410 which is formed in a substantially quadrilateral column shape and is made of a synthetic resin, for example; and a pair of securing metal means 500, 500 which are installed at both end faces of the housing 410 and have arms 510, 520 extending at both sides. The opposed arms 510, 520 of the pair of securing metal means 500 are bent arcuately so that the end portions thereof would be closer to each other. Further, at the most front end of the arms, locking portions 511, 521 bent in a loop shape are formed.

At both side walls of the housing 410, two electrical part-receiving slots 420, 430 are provided which are formed in a long slit-like shape from the side face view, and to which respective terminal portions 210 of the two pieces of the electrical parts 200, 200 are inserted.

As shown in FIGS. 2(*a*) and 2(*b*) also, these electrical part-receiving slots 420, 430 are provided with opposed upper and lower inner walls 422, 423, 432, 433 along the longitudinal direction. At the inmost portions of the lower inner walls 423, 433, slopes 421, 431 which decline toward the lower face of the housing 410, are provided. On these upper and lower inner walls 422, 423, 432, 433, a plurality of retaining grooves 424, 425, 434, 435 are formed in a predetermined pitch and in a fence-like form.

In this case, in one electrical part-receiving slot 420, the retaining groove 424 on the upper inner wall 422 and the retaining groove 425 on the lower inner wall 423, are formed so that these grooves are shifted. Likewise, in another electrical part-receiving slot 430, the retaining groove 434 on the upper inner wall 432 and the retaining groove 435 on the lower inner wall 433, are formed so that these grooves are shifted. Further, the retaining grooves 424, 434 on the upper inner walls 422, 432 in a pair of the electrical part-receiving slots 420, 430, are formed so that these grooves are shifted. Likewise, the retaining grooves 425, 435 on the lower inner walls 423, 433 in a pair of the electrical part-receiving slots 420, 430, are formed so that these grooves are shifted.

Among the respective retaining grooves 424, 425, 434, 435, the upper retaining groove 424 of one electrical part-receiving slot 420 and the lower retaining groove 435 of another electrical part-receiving slot 430 are located at the same position and communicate with each other. At the same time, the upper retaining groove 434 of the electrical part-receiving slot 430, and the lower retaining groove 425 of the electrical part-receiving slot 420, are located at the same position and communicate with each other. These communicating grooves have apertures at the bottom face of the housing 410, and through the apertures, the leg portions of the respective terminals as described below are to be exposed. At the portion where the above communicating grooves are formed at the center of the bottom face of the housing 410, a first locking groove 411 is formed at the upper portion toward the inside of the housing 410, and at the side portion of the bottom face of the housing 410, a second locking groove 412 is formed toward the inside of the housing 410.

Into the retaining grooves 424 and 435, or 434 and 425 which are formed at the same position and communicate with each other, a common terminal 440 as shown in FIG. 2(*a*) or independent terminals 450 and 460 are inserted thereinto. Here, FIGS. 2(*a*) and 2(*b*) show terminals inserted into the retaining grooves 424 and 435 which communicate with each other. The terminals inserted into the retaining grooves 434 and 425 have substantially the same structure provided that the structure is symmetrical to the above, and therefore the following description will be made with respect to the terminals inserted into the retaining grooves 424 and 435.

Firstly, the common terminal 440 as shown in FIG. 2(*a*) will be described. The common terminal 440 has a first contact portion 441 which extends along the retaining groove 424 at the upper side of one electrical part-receiving slot 420, and abuts, from the upper side, on the terminal portion 210 of the electrical part 200 inserted into the receiving slot 420; and a second contact portion 442 which extends along the retaining groove 435 at the lower side of another electrical part-receiving slot 430, and abuts, from the lower side, on the terminal portion 210 of the electrical part 200 inserted into the receiving slot 430.

The lower part of the first contact portion 441 extends downward along the retaining groove 424 of the housing 410 and is bent along the lower face of the housing 410, and at its middle portion, a first locking portion 443 which is inserted into a first locking groove 411 of the housing 410 protrudes upwardly. And, the middle portion is bonded integrally to the lower portion of the second contact portion 442, and extends outwardly from the side portion of the housing 410, and then forms a leg portion 444 which is soldered to a packaging board 300 on which this electrical connector 300 is disposed. Adjacent to and just in front of the leg portion 444, a second locking portion 445 which is inserted into a second locking groove 412 of the housing protrudes upwardly.

Then, a first independent terminal 450 and a second independent terminal 460 as shown in FIG. 2(*b*), will be described below. The first independent terminal 450 extends along the retaining groove 424 at the upper side of the electrical part-receiving slot 420, and has a contact portion 451 which is pressed from the upper side by the terminal 210 of the electrical part 200 inserted into the receiving slot 420; a locking portion 452 which protrudes upwardly from the middle portion so that it would be inserted into the first locking groove 411 of the housing 410; a leg portion 453 which protrudes from the center of the lower face of the housing 410; and a pin portion 454 which protrudes downward at the site adjacent to the leg portion 453, and is inserted into a through hole 310 of the packaging board 300.

The second independent terminal 460 extends along the retaining groove 435 at the lower side of the electrical part-receiving slot 430, and has a contact portion 461 which is pressed from the lower side by the terminal portion 210 of the electrical part 200 inserted into the receiving slot 430; a locking portion 462 which protrudes upwardly from the middle portion so that it would be inserted into the second locking groove 412 of the housing 410; and a leg portion 463 which protrudes from the side edge of the lower face of the housing 410.

At both ends of the housing 410, bosses 470 protrude downward, and by inserting the bosses 470 into securing holes 320 of the packaging board 300, the electrical connector 400 can be positioned on the packaging board 300.

Then, the functions of the electrical connector 400 will be described.

As shown in FIG. 1, the leg portions 444 of the common terminals 440 and the leg portions 463 of the second independent terminals 460 of the electrical connector 400, protrude from both side edges at the lower face of the housing 410, and are aligned in the lines L1 and L2 at both sides. Further, the leg portions 453 of the first independent terminals 450 are exposed from the center of the lower face of the housing 410, and are aligned in the center lines L3 and L4. On the packaging board 300, wirings aligned along these lines, not shown in the drawings, are formed. By inserting the bosses 470 of the electrical connector 400 into the securing holes 320 of the packaging board 300, the leg portions of the above respective terminals abut the wirings formed on the packaging board 300.

By conducting soldering at the above state, the electrical connector 400 can be disposed on the packaging board 300. In this connection, when the electrical connector 400 is disposed on the packaging board 300, the leg portions 453 aligned in the center lines L3 and L4 of the first independent terminals 450 are hidden by the housing 410, whereby the soldering can not be repeated. However, since the pin portion 454 protruding at the site adjacent to the leg portion 453 is inserted into the through hole 310 of the packaging board 300, it is possible to conduct the soldering from the rear side of the packaging board 300.

As shown in FIG. 3, into the two electrical part-receiving slots 420, 430 of the electrical connector 400, two electrical parts 200, 200 are inserted in a diagonal direction so that both faces of the electrical parts would be reverse to each other. And, to the upper faces of the terminal portions 210 of the respective electrical parts 200, the first contact portion 441 of the common terminal 440 or the contact portion 451 of the first independent terminal 450 are pressed. Further, to the lower faces of the terminal portions 210 of the respective electrical parts 200, the second contact portion 442 of the common terminal 440, or the contact portion 461 of the second independent terminal 460, are pressed.

In this case, the position of the first contact portion 441 of the common terminal 440 or the contact portion 451 of the first independent terminal 450, pressed from the upper side, and the position of the second contact portion 442 of the common terminal 440 or the contact portion 461 of the second independent terminal 460, pressed from the lower side, are shifted in a width direction. Accordingly, the electrical parts 200 are slantingly uprighted along the slant faces 421, 431 of the housing 410 as indicated by the imaginary lines B in FIG. 3.

At this state, when the slant electrical parts 200 are pressed down against the pressing force of the respective terminals, both side edge portions of the electrical parts 200 press and open the arms 510, 520 of the respective securing metal means 500 as shown in FIG. 1 outwardly, and come in the lower side of the respective arms 510, 520, and then the locking portions 511, 521 at the ends of the respective arms 510, 520 are engaged with the upper edge of the electrical part 200. As a result, the electrical parts 200 are horizontally fixed relative to the packaging board 300 as indicated by the broken lines C in FIG. 3.

As a result, the terminals of signals common to two pieces of electrical parts, such as a data bus, are connected to the corresponding circuits of the packaging board 300 through the common terminal 440, and at the same time, the terminals of different signals such as row address select signal are separately connected to the corresponding circuits of the packaging board 300 through the first independent terminal 450 or the second Independent terminal 460.

As described above, according to the present invention, the two electrical part-receiving slots to which the electrical parts are inserted are formed at both side walls along the longitudinal direction of the housing. Accordingly, not only can the two electrical parts be inserted, but also the height of the housing can be reduced, whereby it is possible to realize the high densification and thinner-model of the packaging board.

Further, into one electrical part-receiving slot, a terminal portion of one electrical part is inserted, and into another electrical part-receiving slot, a terminal portion of another electrical part is inserted so that both faces of these electrical parts are reverse to each other. Accordingly, when two electrical parts having the same structure, such as memory modules, are inserted, the corresponding terminals can be aligned at the same line, and after electrical connection of the terminals common to the two pieces of electrical parts is conducted with common terminals, the terminals can be connected all together to the corresponding circuits of the packaging board, whereby the corresponding circuits of the packaging board can be simplified.

What is claimed is:

1. An electrical connector, for connecting a first and a second electrical component to a circuit board, each of the electrical components having a plurality of terminal connecting portions aligned along an edge of the electrical component on a top and a bottom side thereof, said connector comprising:

an insulating housing, having first and second component-receiving slots at opposing first and second sides along a longitudinal direction of said housing, each of the slots for receiving the edges of one or the other of the first or second electrical components that include the terminal connecting portions thereon; and at least one terminal arrangement selected from the group consisting of:

(a) a plurality of common terminals, the common terminals comprising:

a first common contact portion, provided in the first component-receiving slot of the housing, which contacts a terminal connecting portion of the first electrical component, a second common contact portion, in common electrical contact with said first common contact portion, provided in said second component-receiving slot of said housing, which contacts a corresponding terminal connecting portion of the second electrical component, a leg portion, which protrudes from a lower portion of said housing, and which abuts on the circuit board and is in electrical communication with the circuit board, and a locking portion, received in a retaining groove of said housing, for securing said common terminal to said housing; and (b) a plurality of independent terminals, each of which comprises:

a first independent contact portion, provided in one of said component-receiving slots, which contacts one of the terminal connecting portions of one of the electrical components, a leg portion, which abuts on the circuit board, and which is in electrical communication with the circuit board, and a locking portion, received in a retaining groove of said housing, for securing said independent terminal to said housing.

2. The electrical connector according to claim 1, wherein the terminal arrangement includes a plurality of independent terminals, and wherein two of said independent terminals are positioned in component-receiving slots opposite one another so that corresponding terminal connecting portions of the first and second electrical components are electrically contacted by said electrical connector independently from one another.

3. The electrical connector according to claim 2, wherein a pin portion, which is inserted into a through hole formed on the circuit board, is provided on a portion of said electrical connector and is in electric communication with one of said independent contact portions and with the circuit board.

* * * * *